US008863622B1

(12) United States Patent
Kingsberry

(10) Patent No.: US 8,863,622 B1
(45) Date of Patent: Oct. 21, 2014

(54) MAGNETIC WRENCH SYSTEMS

(76) Inventor: Stanley Kingsberry, Fayetteville, NC (US)

( * ) Notice: Subject to any disclaimer, the term of this patent is extended or adjusted under 35 U.S.C. 154(b) by 273 days.

(21) Appl. No.: 13/517,769

(22) Filed: Jun. 14, 2012

Related U.S. Application Data

(60) Provisional application No. 61/587,038, filed on Jan. 16, 2012.

(51) Int. Cl.
*B25B 13/02* (2006.01)
*B25B 23/12* (2006.01)

(52) U.S. Cl.
USPC ..... 81/125.1; 81/125

(58) Field of Classification Search
USPC ..... 81/121.1, 125, 125.1, 185, 186
See application file for complete search history.

(56) References Cited

U.S. PATENT DOCUMENTS

| | | | | |
|---|---|---|---|---|
| 3,029,673 | A * | 4/1962 | Mitchell | 81/185 |
| 3,298,260 | A * | 1/1967 | Rothenberg, Jr. | 81/125.1 |
| 3,370,490 | A * | 2/1968 | Feldman et al. | 81/125 |
| 4,738,168 | A | 4/1988 | Carminati | |
| 4,823,652 | A * | 4/1989 | Morrissey et al. | 81/125 |
| 6,295,899 | B1 | 10/2001 | Lee | |
| 6,865,971 | B2 | 3/2004 | Ernesti | |
| 6,810,774 | B2 * | 11/2004 | Hsien | 81/125 |
| 6,955,105 | B2 | 10/2005 | Chen | |
| 7,162,938 | B1 * | 1/2007 | Peters | 81/125 |
| 7,328,636 | B2 * | 2/2008 | Camacho | 81/439 |
| 2010/0275738 | A1 * | 11/2010 | Taylor, Jr. | 81/121.1 |
| 2011/0146462 | A1 * | 6/2011 | Watts et al. | 81/125 |
| 2013/0062286 | A1 * | 3/2013 | Ruiz Hitzky et al. | 210/660 |

* cited by examiner

*Primary Examiner* — Hadi Shakeri
(74) *Attorney, Agent, or Firm* — RG Patent Consulting, LLC; Rachel Gilboy

(57) ABSTRACT

Magnetic Wrench can provide people with a convenient way to install and remove nuts and bolts with a wrench without the nut or bolt slipping out of the wrench and falling onto the floor. This unique product can comprise a wrench with built-in, internal magnets on the openings on both ends. The magnets comprise three small washers placed around the wrench's openings, or a magnetic strip that can follow the curve of the opening. This concept can be applied to both metric and standard wrenches, as well as various shapes and sizes of wrenches. The exact specifications, materials used, and method of use of Magnetic Wrench may vary upon manufacturing.

1 Claim, 6 Drawing Sheets

MAGNETIC WRENCH SYSTEMS

CROSS-REFERENCE TO RELATED APPLICATION

The present application is related to and claims priority from prior provisional application Ser. No. 61/587,038, filed Jan. 16, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of tooling and more specifically relates to magnetic wrenches.

2. Description of the Related Art

Wrenches are hand tools that may be used by used by professionals and non-professionals to perform mechanical work projects such as tightening and loosening of nuts and bolts. Wrenches may come in manual and non-manual versions. These wrenches are used as levers that are fitted to attach to the item to be turned and pressure is exerted to form torque. The torque is used to rotate the item such as a nut or a bolt for example. Many times wrenches may slip causing rounding of the head of a nut and the potential for injury to the hand of the operator.

Nuts and bolts are prone to falling out of wrenches when installing or removing them, especially in tight spots. This can be highly inconvenient, as people may not see where the nuts and bolts fall. When this happens, the nuts and bolts can roll under furniture or vehicle and become lost or can scatter on the floor, causing the individual to spend time searching for and trying to locate them. Additionally, over time, it can be costly to lose these pieces and have to constantly replace them. Productivity is minimized because of these conditions.

Various attempts have been made to solve the above-mentioned problems such as those found in U.S. Pat. No. 6,955,105; 2011/0146462; U.S. Pat. Nos. 6,295,899; 6,865,971; 4,738,168; and 3,370,490. This prior art is representative of wrench tooling. None of the above inventions and patents, taken either singly or in combination, is seen to describe the invention as claimed.

Ideally, magnetic wrenches should be user-friendly, safe in-use, require a minimum of maintenance and, yet would operate reliably and be manufactured at a modest expense. Thus, a need exists for a reliable magnetic wrench system to avoid the above-mentioned problems.

BRIEF SUMMARY OF THE INVENTION

In view of the foregoing disadvantages inherent in the known wrench and hand tool art, the present invention provides a novel magnetic wrench system. The general purpose of the present invention, which will be described subsequently in greater detail is to provide safe and efficient magnetic wrench to increase productivity during mechanical operations.

Magnetic wrench of the present invention can prevent nuts and bolts from falling on the ground and becoming lost when installing and removing them. This innovative product can resemble a traditional metal wrench with magnets (internal or external) on each end (or on one end) that can secure nuts and bolts to the wrench. Mechanics, home repair workers, engineers, at-home do-it-yourselfers, construction workers, contractors, and military personnel can all appreciate the convenience and practicality afforded by this product.

A magnetic wrench system is disclosed herein, in a preferred embodiment comprising: a magnetic wrench including a handle member having a proximate end; and a distal end; a first head having an inner surface; a second head having an inside surface; a first magnetic surface insert member; and a second magnetic surface insert member. A first head is integrally-formed on the proximate end of the handle member, and a second head is integrally-formed on the distal end of the handle member (on the opposing side). The handle member provides a lever (levering means) whereby a fastener (nut/bolt or the like) is able to be turned by the first head, the first head able to suitably grip the fastener for rotation about an axis. In preferred embodiments the handle member, the first head, and the second head (the entire wrench in preferred embodiments and in alternate embodiments only a portion thereof) may be treated with ferrofluid. Surface treating and/or layering to induce magnetism may be used. The handle member may further comprise a rubber sleeve such as with those embodiments being used by electricians and when it is undesirable that the entire wrench be magnetized.

The handle member is able to turn the fastener (in a similar manner, but not simultaneously with the first head being used) using the second head, the second head also able to suitably grip the fastener for rotation. In certain embodiments such as pipe wrenches and crescent wrenches the first head and second head may be substantially parallel and may be located on the proximate end (or distal end) of the handle member (distal end and proximate end may be located reasonably close together—not on separate ends, and first head and second head may be adjusted in relation to each other); however in open and closed-end and combination wrench embodiments they may be located on opposing ends. The handle member is defined in length by the proximate end and the distal end. The first magnetic surface insert member is affixed (via molding means, adhesive, clipped, welded or otherwise attached via suitable means) to the inner surface of the first head (may be round in closed-end versions, arcuate in open-ended versions; or flat in crescent and pipe wrench versions.) The second magnetic surface insert member is affixed to the inside surface of the second head. Certain first and second magnetic surface insert members may comprise gripping means such as teeth.

The first magnetic surface insert member and second magnetic surface insert member (or magnets otherwise embedded) comprises rare earth magnets in preferred embodiments; wherein the rare earth magnets comprise a magnetic field in excess of about 1.4 teslas. Alternate embodiments may use different magnets and combinations thereof; however other magnets are not preferred because they do not typically comprise the desirable high-quality magnetic properties. The first magnetic surface insert member and the second magnetic surface insert member provide magnetic attraction between the fastener and the magnetic wrench such that the magnetic wrench is able to better (more securely) hold and grip the fastener when the fastener is being manipulated during rotational torquing (tightening or loosening.)

A kit for manufacture or sale is described herein comprising the various wrenches discussed and shown herein.

A method of manufacturing a magnetic wrench is also described herein preferably comprising the steps of: dipping a wrench into a ferrofluid; magnetizing the wrench to create a magnetic wrench; affixing a first magnetic surface insert member to an inner surface of a first head; and affixing a second magnetic surface insert member to an inside surface of a second head. The method may further comprise the step of applying a rubber sleeve to a handle member of the magnetic wrench.

The present invention holds significant improvements and serves as a magnetic wrench system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, magnetic wrench (system), constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a hand tool device and more particularly to a magnetic wrench system as used to improve the efficiency of mechanical wrenching projects.

Generally speaking, magnetic wrench can provide individuals with a convenient way to install and remove nuts and bolts with a wrench without the nut or bolt slipping out of the wrench and falling onto the floor. This unique product can comprise a wrench with built-in, internal magnets on (or in) the openings on both ends, or surface mounted inserts. The magnets can consist of three small washers placed around the wrench's openings, or a magnetic strip that can follow the curve of the opening (surface mounted inserts.) This concept can be applied to both metric and standard wrenches, as well as various shapes and sizes of wrenches.

Figure 1:
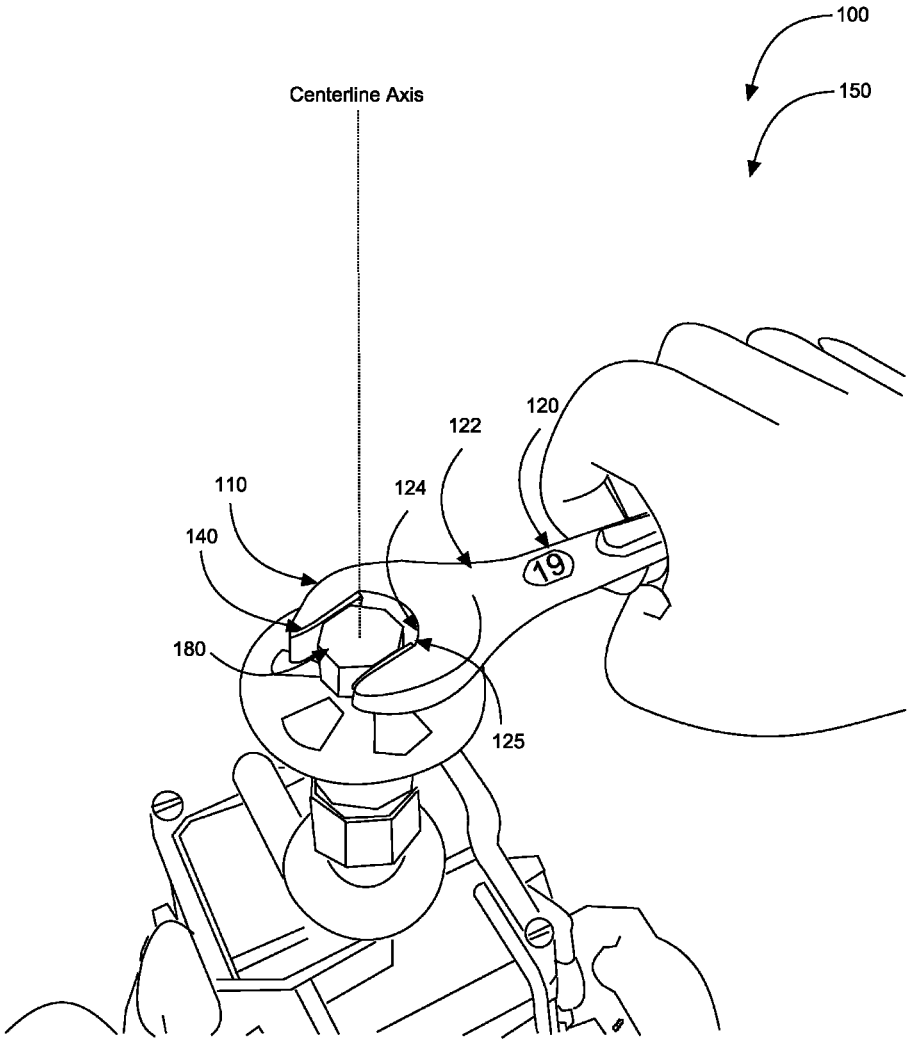
FIG. 1 shows a perspective view illustrating a magnetic wrench in an in-use condition according to an embodiment of the present invention.

Referring to the drawings by numerals of reference there is shown in FIG. 1, a perspective view illustrating magnetic wrench 110 in an in-use condition 150 according to an embodiment of the present invention.

Magnetic wrench 110 (of magnetic wrench system 100) comprises: handle member 120 having proximate end 122; and distal end 126; first head 124 having an inner surface 125; second head 130 having inside surface 132; first magnetic surface insert member 140; and second magnetic surface insert member 144; wherein first head 124 is integrally-formed on proximate end 122 of handle member 120; and second head 130 is integrally-formed on distal end 126 of handle member 120 (in embodiments such adjustable crescent wrench 220 and pipe wrench 270 (shown in FIGS. 2B, 4 and 5) first magnetic surface insert member 140 and second magnetic surface insert member 144 may be located substantially parallel. In these embodiments first magnetic surface insert member 140 and second magnetic surface insert member 144 may be needed in combination to grip and rotate fastener 180.)

Handle member 120 provides a lever whereby fastener 180 is able to be turned by first head 124, first head 124 able to suitably grip fastener 180 for rotation about an axis (shown as centerline axis); wherein handle member 120 is alternately able to turn fastener 180 using second head 130, second head 130 able to suitably grip fastener 180 for rotation (perpendicular rotation in relation to centerline axis), this referring to open-ended-wrench 200, closed-ended-wrench 240, double open-ended wrench 520, and combination wrench 260 versions of magnetic wrench 110.

First magnetic surface insert member 140 is affixed to inner surface 125 of first head 124; wherein second magnetic surface insert member 144 is affixed to inside surface 132 of second head 124. First magnetic surface insert member 140 and second magnetic surface insert member 144 provide magnetic attraction between fastener 180 (fastener 180 comprising ferrous material such as mild steel or the like) and magnetic wrench 110 such that magnetic wrench 110 is able to better hold and grip fastener 180 when fastener 180 is being manipulated during rotational torquing. Handle member 120, first head 124, and second head 130 may be treated with ferrofluid in certain embodiments.

The ferrofluid used within the present invention comprises a stable colloidal suspension of sub-domain magnetic particles in a liquid carrier. The particles, which have an average size of about 100 Å (10 nm), are coated with a stabilizing dispersing agent (surfactant) which prevents particle agglomeration even when a strong magnetic field gradient is applied to the ferrofluid. The surfactant must be matched to the carrier type and must overcome the attractive Van Der Waals and magnetic forces between the particles. The ferrofluid may contain by volume 5% magnetic solid, 10% surfactant and 85% carrier.

Magnetic Behavior of Ferrofluid: In the absence of a magnetic field, the magnetic moments of the particles are randomly distributed and the fluid has no net magnetization. When a magnetic field is applied to a ferrofluid, the magnetic moments of the particles orient along the field lines almost instantly. The magnetization of the ferrofluid responds immediately to the changes in the applied magnetic field and when the applied field is removed, the moments randomize quickly.

In a gradient field the whole fluid responds as a homogeneous magnetic liquid which moves to the region of highest flux. This provides that the ferrofluid can be precisely positioned and controlled by an external magnetic field. The forces holding the magnetic fluid in place are proportional to the gradient of the external field and the magnetization value of the fluid, meaning that the retention force of the ferrofluid can be adjusted by changing either the magnetization of the fluid or the magnetic field in the region. Magnetic wrench 110 may be dipped or otherwise treated with the ferrofluid according to preferred methods and processes of manufacturers such that magnetic wrench 110 is inexpensively magnetized in whole or in part. This particular feature is desirable in that it is a cost-effective magnetizing means.

First magnetic surface insert member 140 and second magnetic surface insert member 144 may comprise rare earth magnets. Rare earth magnets comprise a magnetic field in excess of about 1.4 teslas in preferred embodiments; however other embodiments may comprise more or less magnetic strength, as desired.

First magnetic surface insert member 140 and second magnetic surface insert member 144 may be exposed (external), or unexposed (integral within confines of magnetic wrench 110 inlaid/inset underneath the surface of wrench.) Inlaid/inset versions may be produced during the pour of the wrench or the like. Alternately a plurality of barrel magnets; rectangular-bar, ring, circular, cube, horseshoe and the like may be inserted in first head 124 and/or second head 130 and/or handle member 120. In these embodiments 3 or more magnets may be used such that sufficient magnetism is attained (magnets may be drilled and inserted into jaws or the like.)

Figures 2A, 2B, 2C:
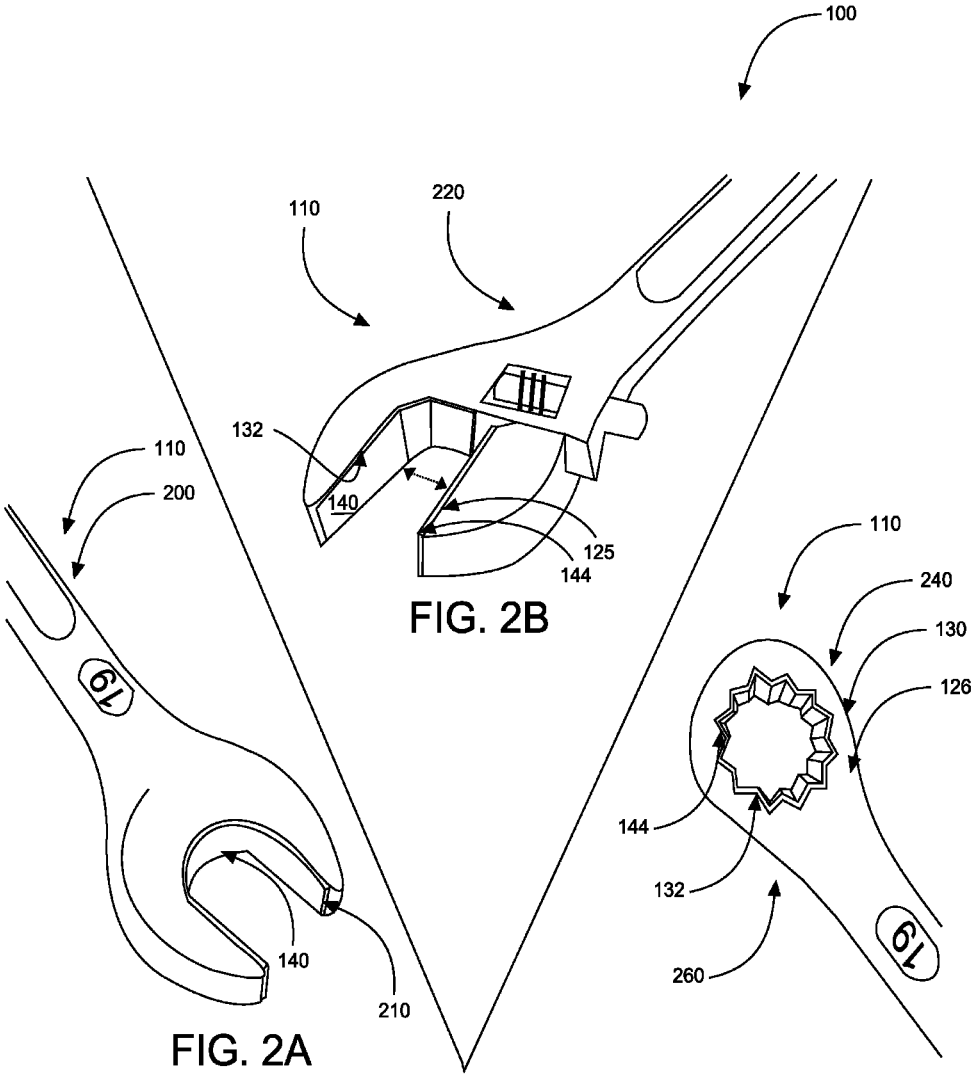
FIG. 2A is a perspective view illustrating an open-ended-wrench having a first magnetic surface insert member comprising a formed u-shape according to an embodiment of the present invention of FIG. 1.
FIG. 2B is a perspective view illustrating an adjustable crescent wrench (an alternate embodiment of the magnetic wrench) according to an embodiment of the present invention of FIG. 1.
FIG. 2C is a perspective view illustrating another version of the magnetic wrench comprising a closed-ended-wrench wherein a second magnetic surface insert member comprises either a 6-point insert-ring or a 12-point insert-ring according to an embodiment of the present invention of FIG. 1.

Referring now to FIG. 2A a perspective view illustrating open-ended-wrench 200 (version of magnetic wrench 110) having first magnetic surface insert member 140 comprising formed u-shape 210 according to an embodiment of the present invention of FIG. 1.

Figure 5:
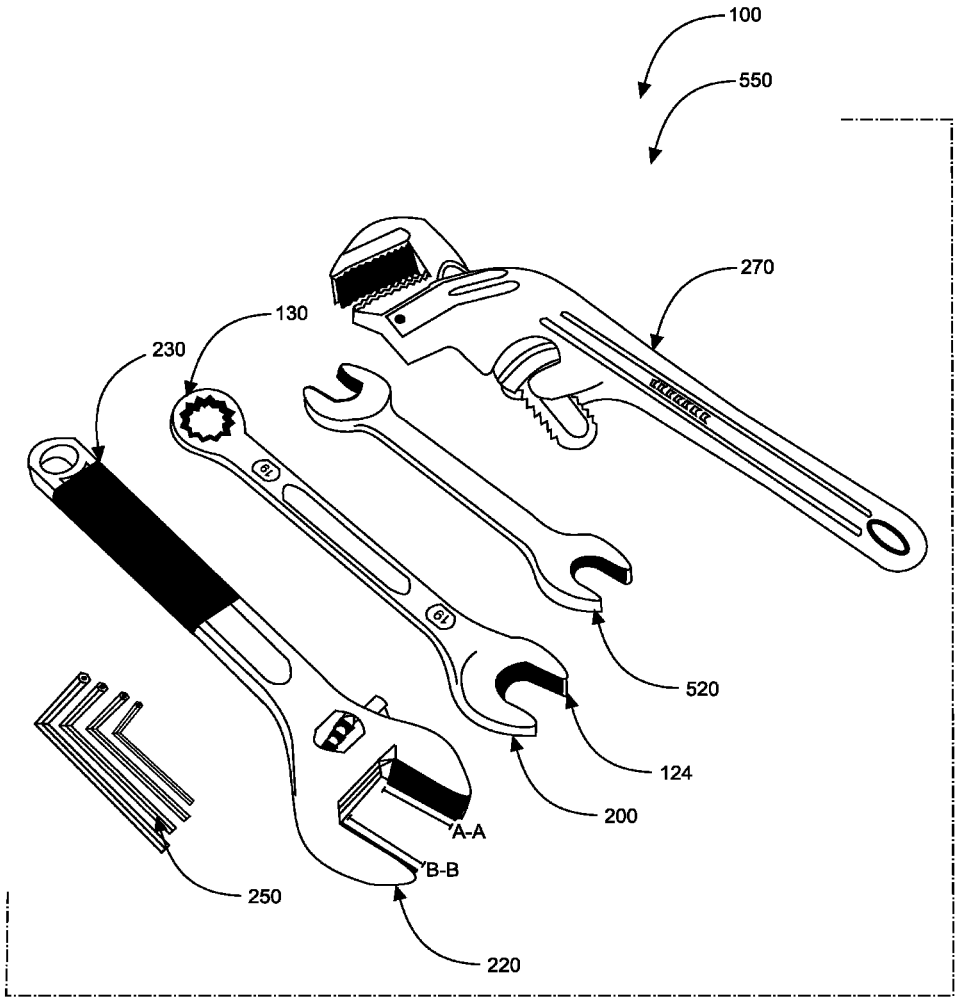
FIG. 5 is a kit illustrating an Allen wrench set; a crescent wrench; a combination wrench; an open-end wrench and a pipe wrench (left to right) according to embodiments of the present invention of FIGS. 1-4.

Magnetic wrench 110 may comprise open-ended-wrench 200 in this particular embodiment shown. First magnetic surface insert member 140 in this specific embodiment shown comprises formed u-shape 210. Magnetic wrench 110 may further comprise second magnetic surface insert member 144 comprising formed u-shape 210 in double open-ended wrench 520 versions such as shown in FIG. 5. Formed u-shape 210 may comprise a single or multiple-piece construction as per manufacturer preference.

FIG. 2B is a perspective view illustrating adjustable crescent wrench 220 (an alternate embodiment of magnetic wrench 110) according to an embodiment of the present invention of FIG. 1.

Magnetic wrench 110 comprises adjustable crescent wrench 220 in yet another embodiment of magnetic wrench 110 in magnetic wrench system 100. Handle member 120 may further comprise rubber sleeve 230, as shown in FIG. 5. Other embodiments may also comprise rubber sleeve 230.

Referring now to FIG. 2C, a perspective view illustrating yet another version of magnetic wrench 110 comprising closed-ended-wrench 240 wherein second magnetic surface insert member 144 comprises either a 6-point insert-ring or a 12-point insert-ring according to an embodiment of the present invention of FIG. 1. Other wrenches such as stub wrenches and the like may comprise magnetic wrench 110. Magnetic wrench 110 is shown comprising closed-ended-wrench 240 wherein one or both ends may be 'closed'. First and second magnetic surface insert member (140 and 144, respectively) may be found in metric and standard versions. Second magnetic surface insert member 144 and/or first magnetic surface insert member 140 may comprise 6- or 12-point insert-ring(s).

Figure 3:
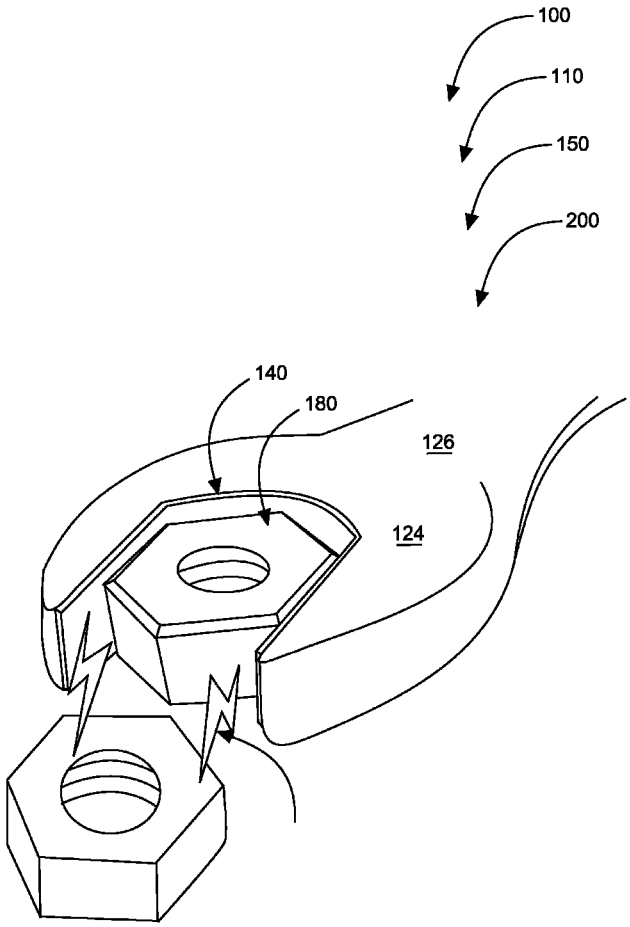
FIG. 3 is a perspective view illustrating a fastener (nut) as held by the open-ended-wrench according to an embodiment of the present invention of FIGS. 1 and 2A.

Referring now to FIG. 3, a perspective view illustrating fastener 180 (nut) as held by open-ended-wrench 200 according to an embodiment of the present invention of FIGS. 1 and 2A. Fastener 180 may comprise a nut, bolt or the like. The magnetism feature present provides that fasteners 180 are not easily lost by fastener 180 falling out of first head 124 or second head 130 or first head 124 and second head 130.

Figure 4:
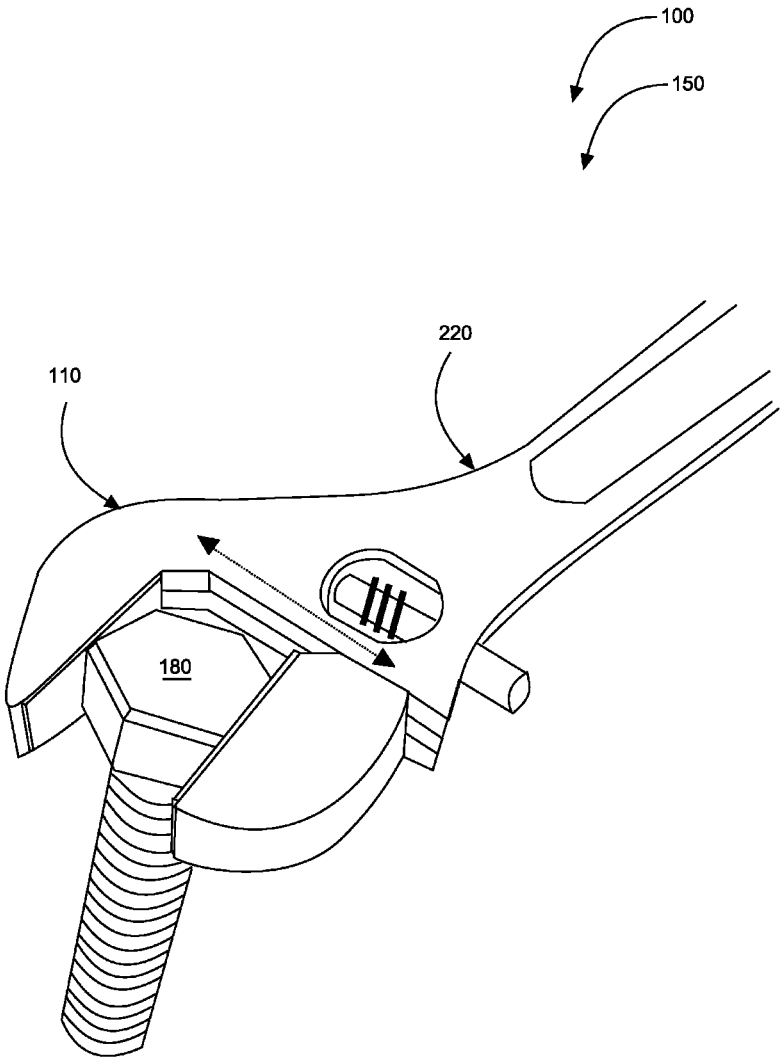
FIG. 4 is a perspective view illustrating another fastener (bolt) as held by the adjustable crescent wrench according to an embodiment of the present invention of FIGS. 1 and 2B.

Referring now to FIG. 4, a perspective view illustrating another fastener 180 (bolt) as held by adjustable crescent wrench 220 according to an embodiment of the present invention of FIGS. 1 and 2B. Magnetic wrench 110 may comprise adjustable crescent wrench 220 in the embodiment shown. A first length (designated B-B) of first magnetic surface insert member 140 is greater than a second length (designated A-A) of second magnetic surface insert member 144. Second length (designated A-A) is shorter due to the design of adjustable crescent wrench 220. This may also apply in pipe wrench 270 versions. A-A and B-B are oriented substantially parallel in these embodiments due to the construction of jaws that work in combination to secure fastener 180 there-between.

Referring now to FIG. 5, a kit 550 illustrating Allen wrench set 250; adjustable crescent wrench 220; combination wrench 260; open-end wrench 200 and pipe wrench 270 according to an embodiment of the present invention of FIGS. 1-4.

Magnetic wrench 110 comprises pipe wrench 270 in certain embodiments. First magnetic surface insert member 140 and second magnetic surface insert member 144 each comprise teeth in this particular embodiment. First magnetic surface insert member 140 and second magnetic surface insert member 144 are of a substantially planar profile. Magnetic wrench 110 comprises Allen wrenches (Allen wrench set 250) wherein first magnetic surface insert member 140 comprises an interior rod or inserted barrel magnet (as shown in FIG. 6) or the like adjacent an end of the wrenches.

Magnetic wrench system 100 may be sold as kit 550 comprising the following tools: at least one Allen wrench set 250 at least one adjustable crescent wrench 220; at least one combination wrench 260; at least one double open-ended wrench 520; at least one pipe wrench 270; and at least one set of user instructions. Magnetic wrench system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including different tools, customized parts, different magnet combinations and orientations, parts may be sold separately, etc., may be sufficient.

Figure 6:
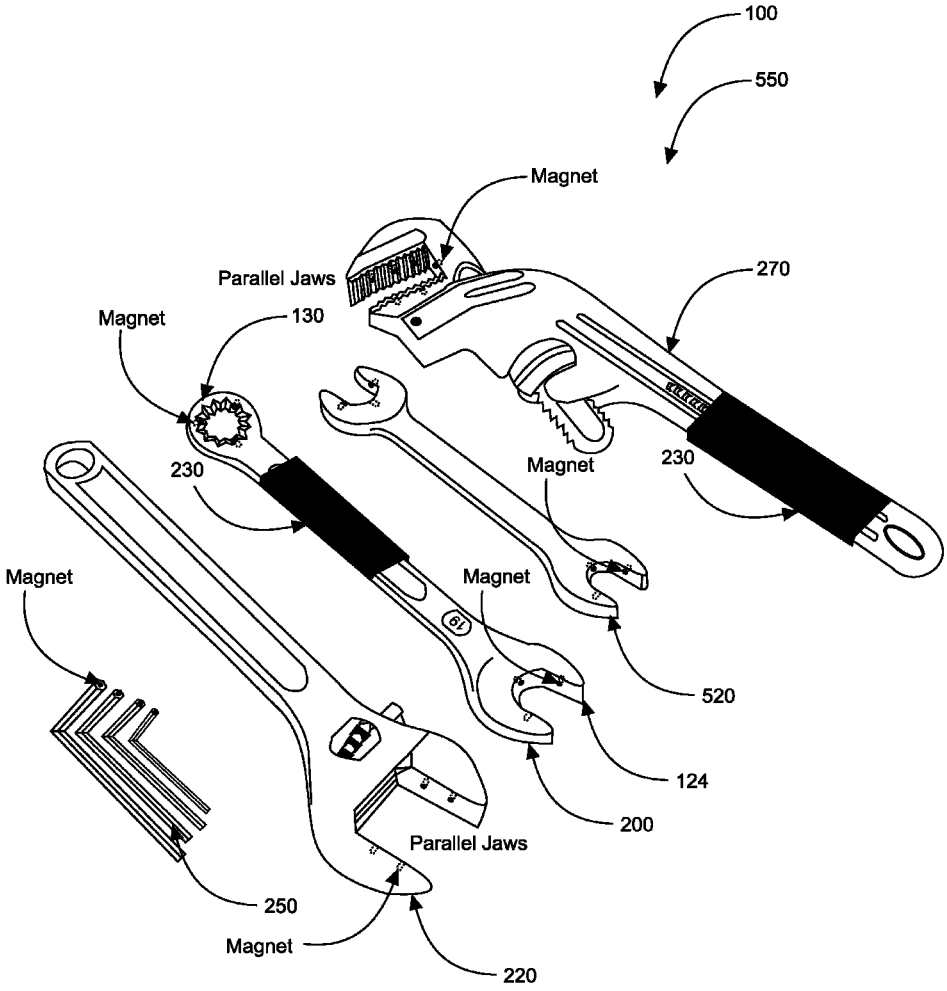
FIG. 6 illustrates an Allen wrench set; a crescent wrench; a combination wrench; an open-end wrench and a pipe wrench (left to right) according to alternate embodiments of the present invention of FIGS. 1-5.

FIG. 6 illustrates Allen wrench set 250; adjustable crescent wrench 220; combination wrench 260; open-end wrench 200 and pipe wrench 270 (left to right) according to alternate embodiments of the present invention of FIGS. 1-5.

Allen wrench set 250; adjustable crescent wrench 220; combination wrench 260; open-end wrench 200 and pipe wrench 270 or other such tools not described herein may find use as magnetized tools. These particular embodiments may comprise a plurality of embedded magnets (first, second, third, fourth magnetic insert members inset as shown). The use of a plurality of these magnets (3 or 4 or more) in the strategic positioning shown may serve to hold fastener 180 securely before and during (and after if loosening) tightening and/or loosening episodes. The use of a plurality of magnets being positioned about (into) the interior of the jaws enhances magnetic 'pull' from a variety of directions so as to better secure fastener 180. This particular embodiment(s) may also comprise magnetic wrenches 110 being treated with ferrofluid or other suitably equivalent solution/treatment.

A method of manufacturing a magnetic wrench 110 preferably comprises the steps of: step one dipping a wrench into a ferrofluid; magnetizing wrench to create magnetic wrench 110; affixing a first magnetic surface insert member 140 to inner surface 125 of first head 124; and affixing a second magnetic surface insert member 144 to an inside surface 132 of second head 130. The method may further comprise the step of applying a rubber sleeve 230 to handle member 120 of magnetic wrench 110.

It should be noted that the steps described in the method of manufacture can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A magnetic wrench system comprising:

a magnetic wrench including;

a handle member having;

a proximate end; and a distal end;

a first head having an inner surface;

a second head having an inside surface;

at least one first magnetic insert member; and at least one second magnetic insert member;

wherein said handle member is defined in length by said proximate end and said distal end;

wherein said first head is located on said handle member;

wherein said second head is located on said handle member;

wherein said handle member provides a lever whereby a fastener is able to be turned by said first head, said first head able to suitably grip said fastener for rotation about an axis;

wherein said handle member, said first head, and said second head are treated with ferrofluid;

wherein said handle member further comprises a rubber sleeve;

wherein said handle member is alternately able to turn said fastener using said second head, said second head able to suitably grip said fastener for rotation;

wherein said first magnetic insert member is affixed into said inner surface of said first head;

wherein said second magnetic insert member is affixed into said inside surface of said second head;

wherein said first magnetic insert member and said second magnetic insert member comprises rare earth magnets;

wherein said rare earth magnets comprise a magnetic field in excess of about 1.4 teslas; and wherein said first magnetic insert member and said second surface insert member provide magnetic attraction between said fastener and said magnetic wrench such that said magnetic wrench is able to better hold and grip said fastener when said fastener is being manipulated during rotational torquing.

* * * * *